US010294601B2

(12) United States Patent
Kim et al.

(10) Patent No.: US 10,294,601 B2
(45) Date of Patent: May 21, 2019

(54) LAUNDRY TREATING APPARATUS

(71) Applicant: LG ELECTRONICS INC., Seoul (KR)

(72) Inventors: Wooseong Kim, Seoul (KR); Jihong Lee, Seoul (KR); Kijung Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 49 days.

(21) Appl. No.: 15/255,299

(22) Filed: Sep. 2, 2016

(65) Prior Publication Data

US 2017/0067200 A1 Mar. 9, 2017

(30) Foreign Application Priority Data

Sep. 4, 2015 (KR) ..... 10-2015-0125729

(51) Int. Cl.
*D06F 37/26* (2006.01)
*D06F 37/02* (2006.01)
(Continued)

(52) U.S. Cl.
CPC ..... *D06F 37/26* (2013.01); *D06F 37/02* (2013.01); *D06F 39/083* (2013.01); *D06F 39/085* (2013.01); *D06F 29/00* (2013.01)

(58) Field of Classification Search
CPC ..... D06F 29/00; D06F 37/02; D06F 39/083; D06F 37/26; D06F 39/085
See application file for complete search history.

(56) References Cited

U.S. PATENT DOCUMENTS 3,425,437 A * 2/1969 Knerr ..... D06F 39/083 137/119.05
2003/0121293 A1 7/2003 Killane
(Continued)

FOREIGN PATENT DOCUMENTS

CN 101578409 11/2009
CN 102216515 10/2011
(Continued)

OTHER PUBLICATIONS

European Search Report in European Application No. 16186921.9-1710, dated Jan. 3, 2017, 9 pages (with English translation).
(Continued)

*Primary Examiner* — Joseph L. Perrin
(74) *Attorney, Agent, or Firm* — Fish & Richardson P.C.

(57) ABSTRACT

A laundry treating apparatus includes a cabinet. The laundry treating apparatus further includes a tub that is located in the cabinet and that is configured to receive washing water. The laundry treating apparatus further includes a drum that is configured to rotate, that is located in the tub, and that is configured to receive laundry. The laundry treating apparatus further includes a drainage pump that is configured to pump washing water out of the tub. The laundry treating apparatus further includes a connection passage that is configured to guide washing water that is pumped out of the tub by the drainage pump. The laundry treating apparatus further includes a connector that is connected to the connection passage and that is configured to guide washing water out of the cabinet. The connector includes a connector inlet port and a connector outlet port.

21 Claims, 13 Drawing Sheets

(51) Int. Cl.
*D06F 39/08* (2006.01)
*D06F 29/00* (2006.01)

(56) References Cited

U.S. PATENT DOCUMENTS

| | | | | |
|---|---|---|---|---|
| 2009/0145176 | A1 | 6/2009 | Kim et al. | |
| 2009/0158784 | A1* | 6/2009 | Kim | D06F 31/00 68/27 |
| 2010/0064736 | A1 | 3/2010 | Jeong et al. | |
| 2010/0107704 | A1* | 5/2010 | Seo | D06F 39/02 68/17 R |
| 2011/0232698 | A1 | 9/2011 | Caudevilla et al. | |
| 2011/0265524 | A1* | 11/2011 | Kim | D06F 29/00 68/13 R |
| 2011/0284094 | A1 | 11/2011 | Chilcoat et al. | |
| 2012/0255330 | A1 | 10/2012 | Wanweerakul | |
| 2015/0059418 | A1 | 3/2015 | Lee et al. | |
| 2015/0345062 | A1* | 12/2015 | Lee | D06F 39/08 68/27 |

FOREIGN PATENT DOCUMENTS

| | | |
|---|---|---|
| CN | 103710934 | 4/2014 |
| CN | 104420122 | 3/2015 |
| DE | 3627732 | 2/1988 |
| EP | 1350884 | 10/2003 |
| EP | 1783263 | 5/2007 |
| EP | 2065505 | 6/2009 |
| WO | 2012150539 | 11/2012 |

OTHER PUBLICATIONS

International Search Report and Written Opinion in International Application No. PCT/KR2016/009834, dated Dec. 13, 2016, 14 pages.
Chinese Office Action in Chinese Application No. 201610803824.1, dated May 24, 2018, 19 pages.
Chinese Notice of Allowance in Chinese Appln. No. 201610803824.1, dated Feb. 25, 2019, 7 pages (with English translation).

* cited by examiner

【fig 1】
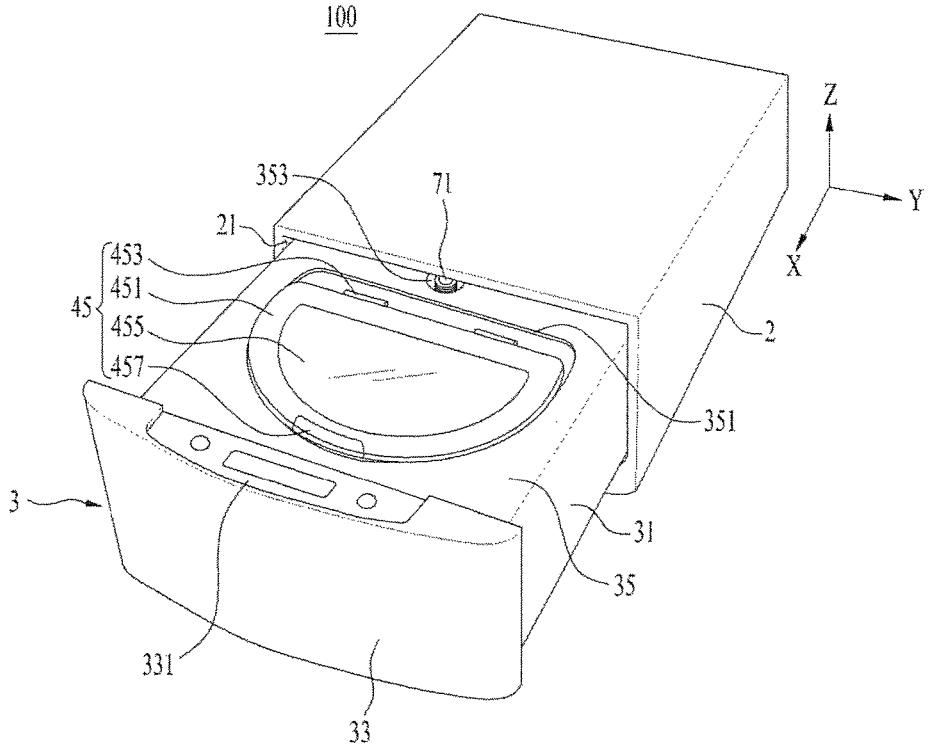

【fig 2】
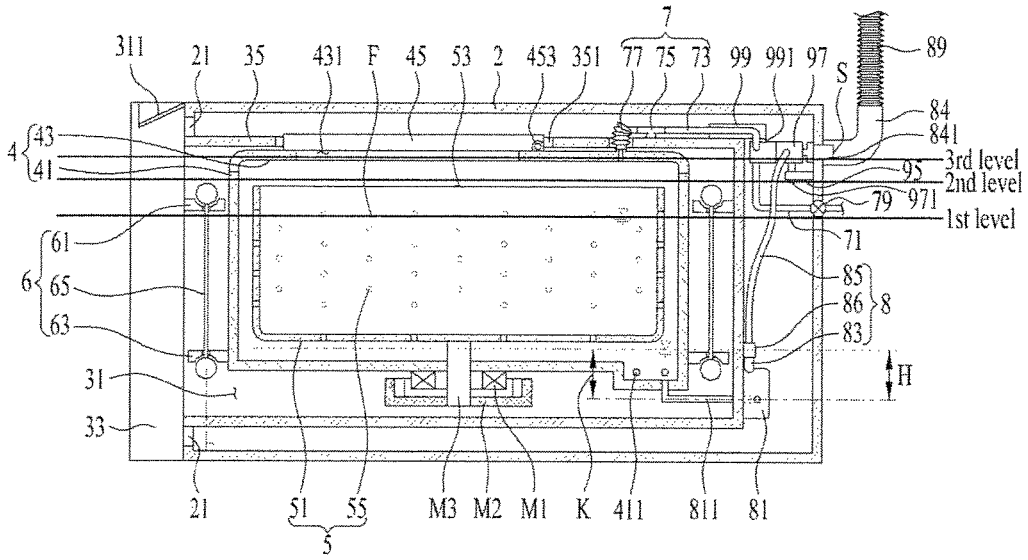

【fig 3】
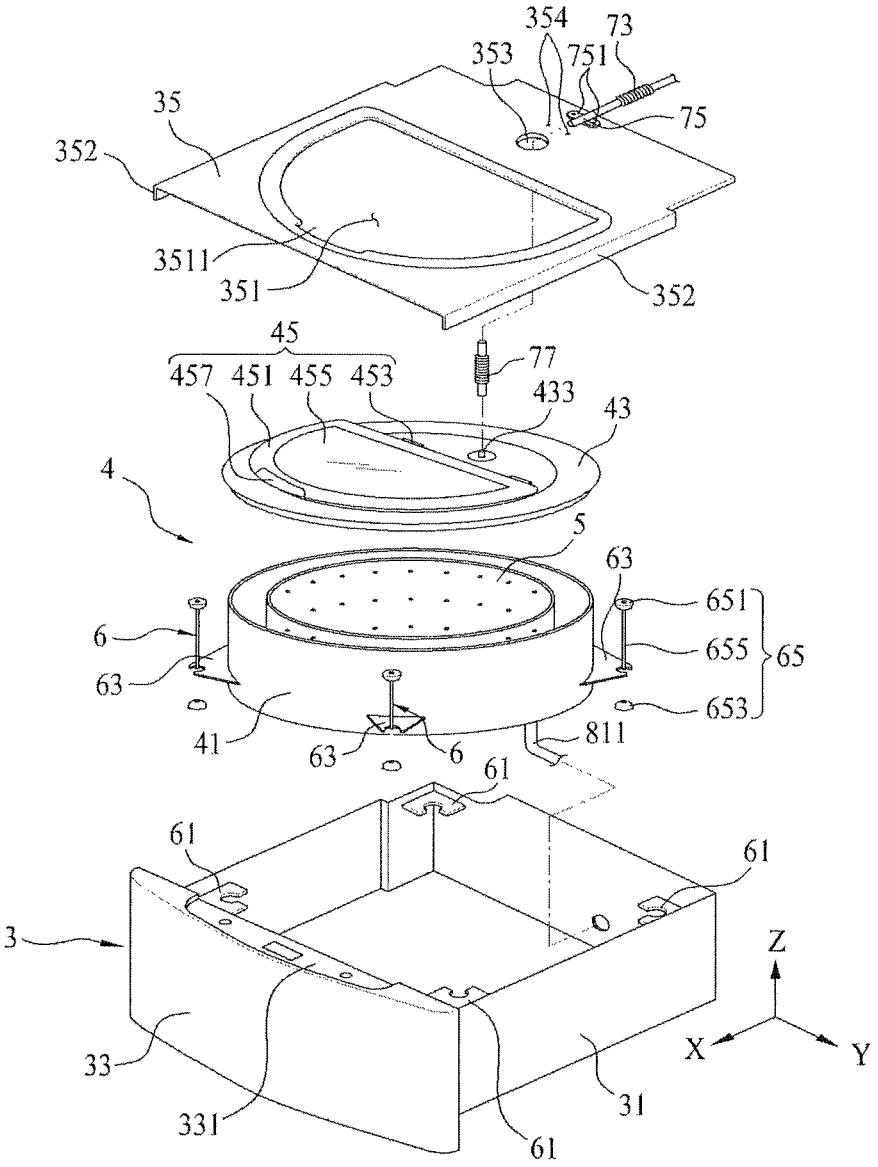

【fig 4】
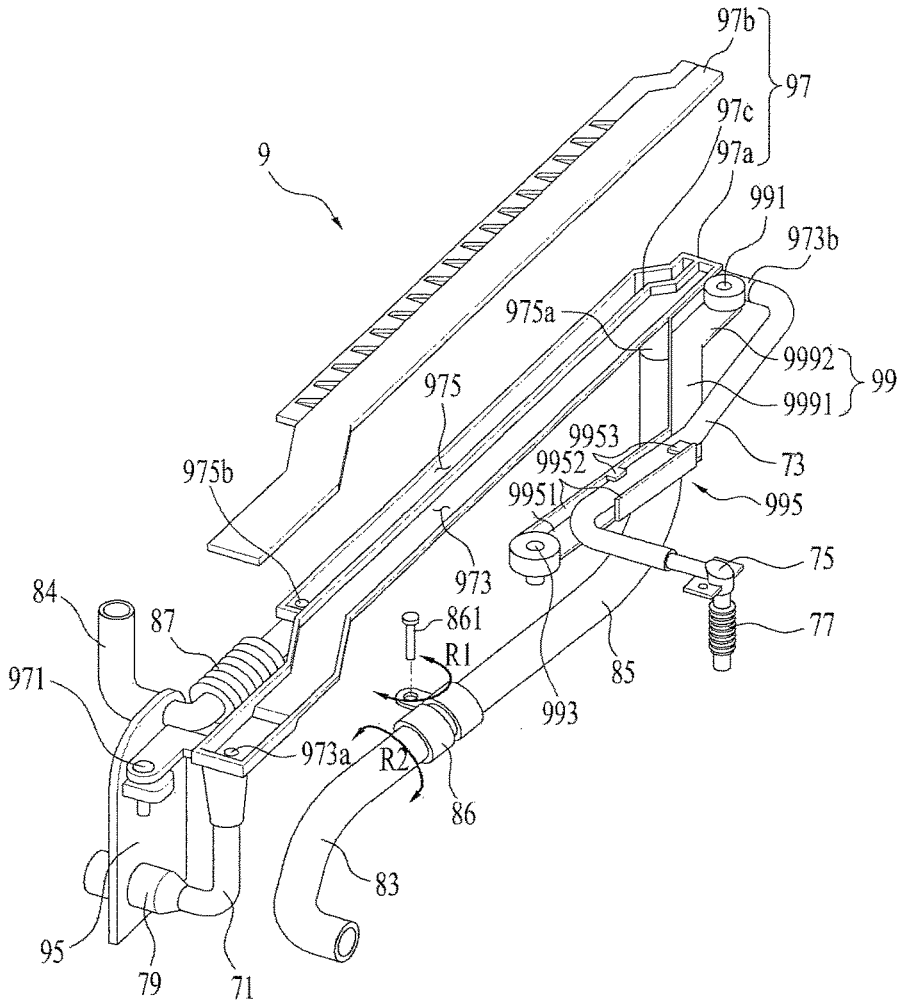

【fig 5】
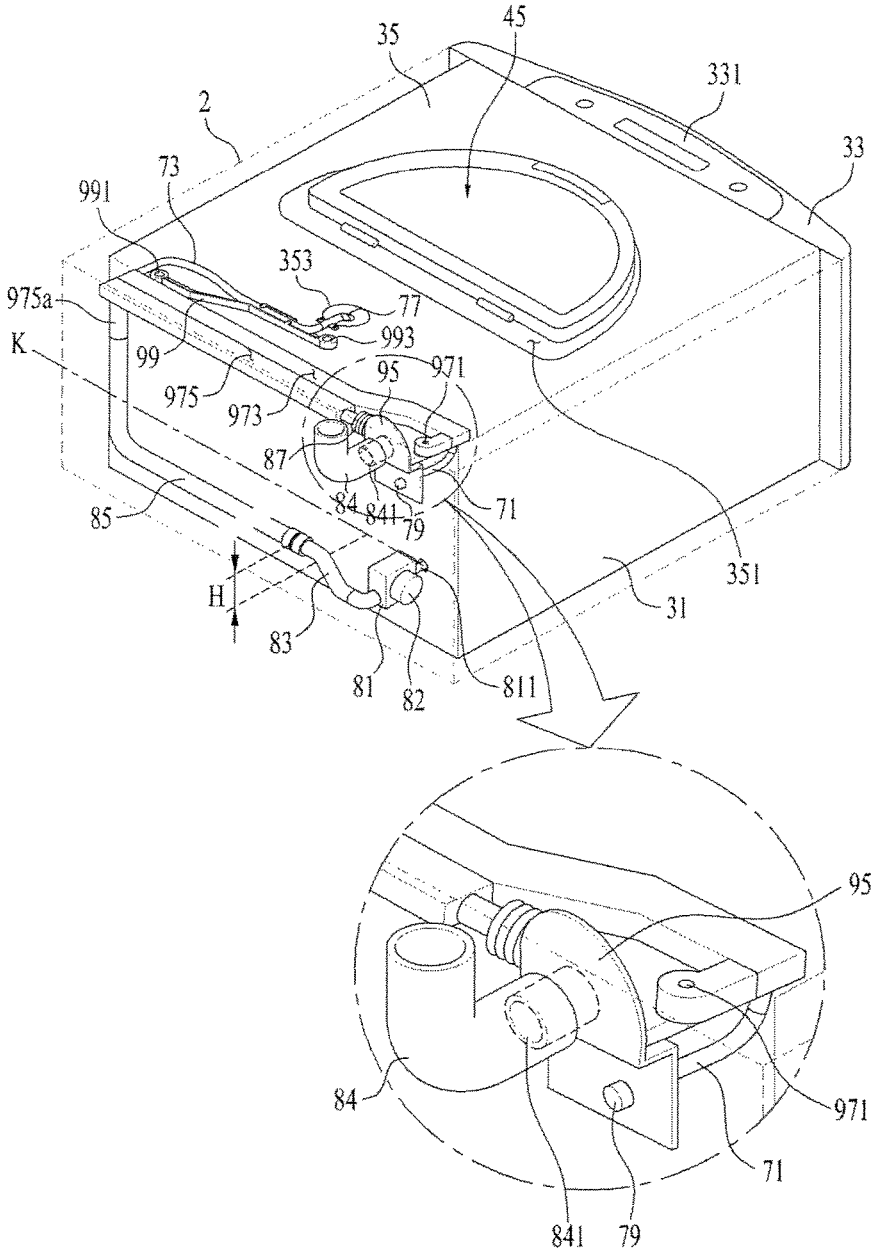

【fig 6】
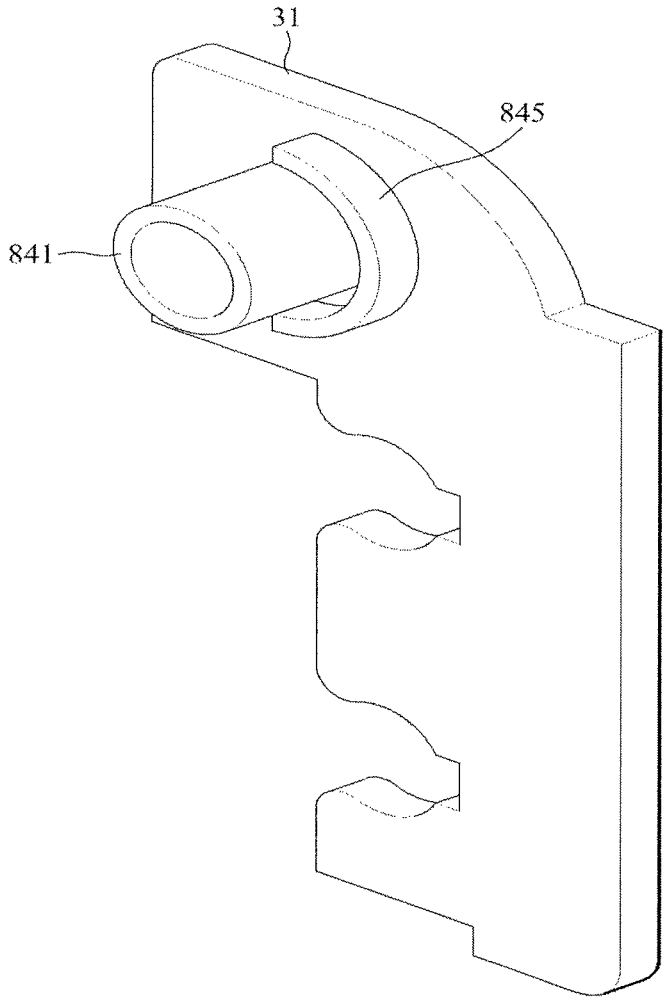

【fig 7】
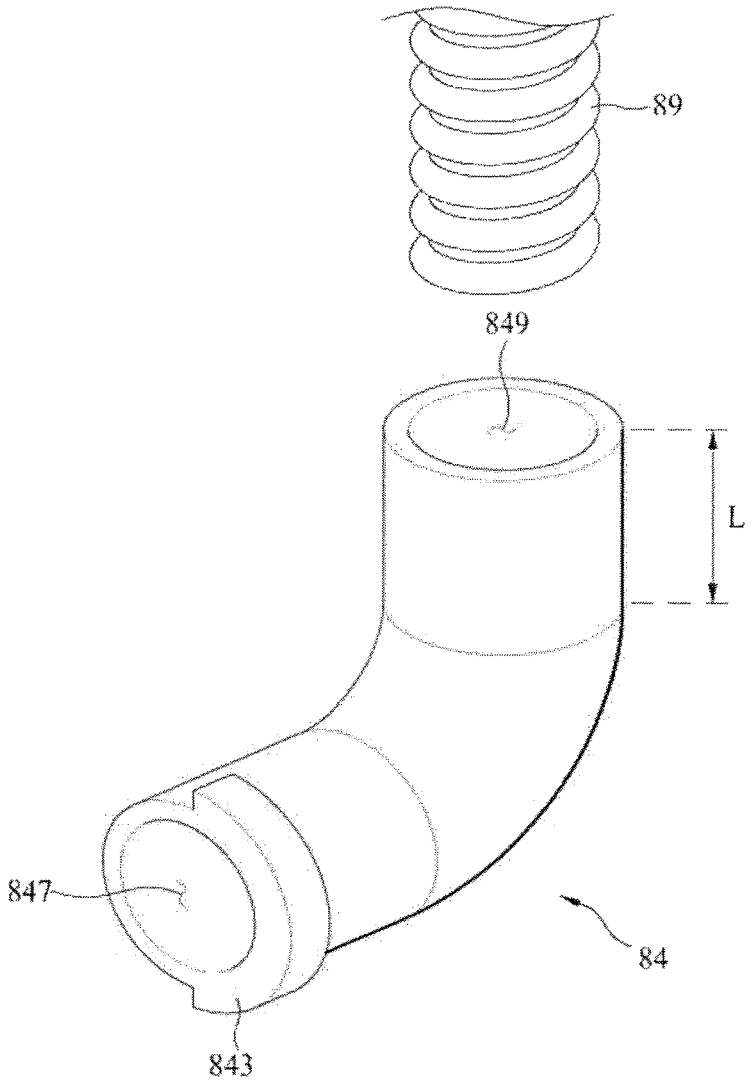

【fig 8】
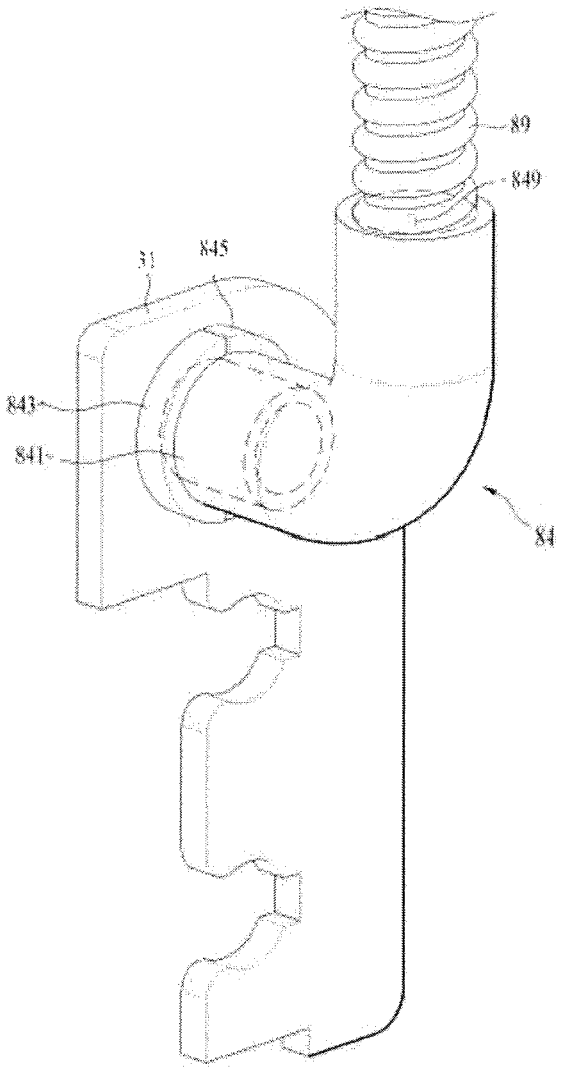

【fig 9】
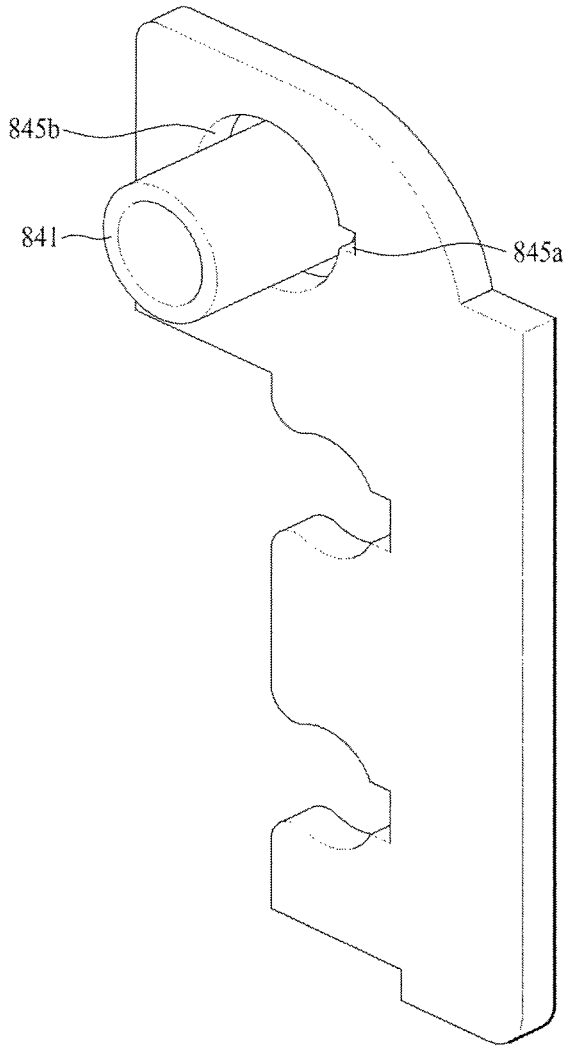

【fig 10】
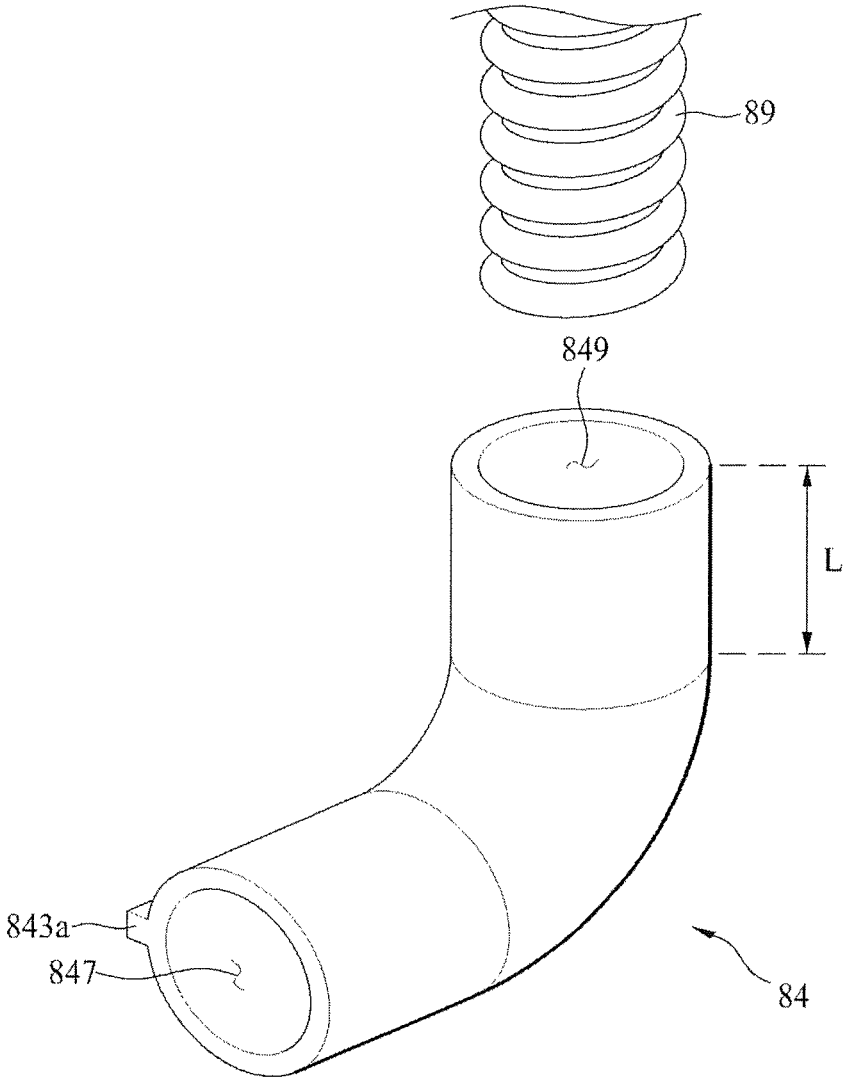

【fig 11】
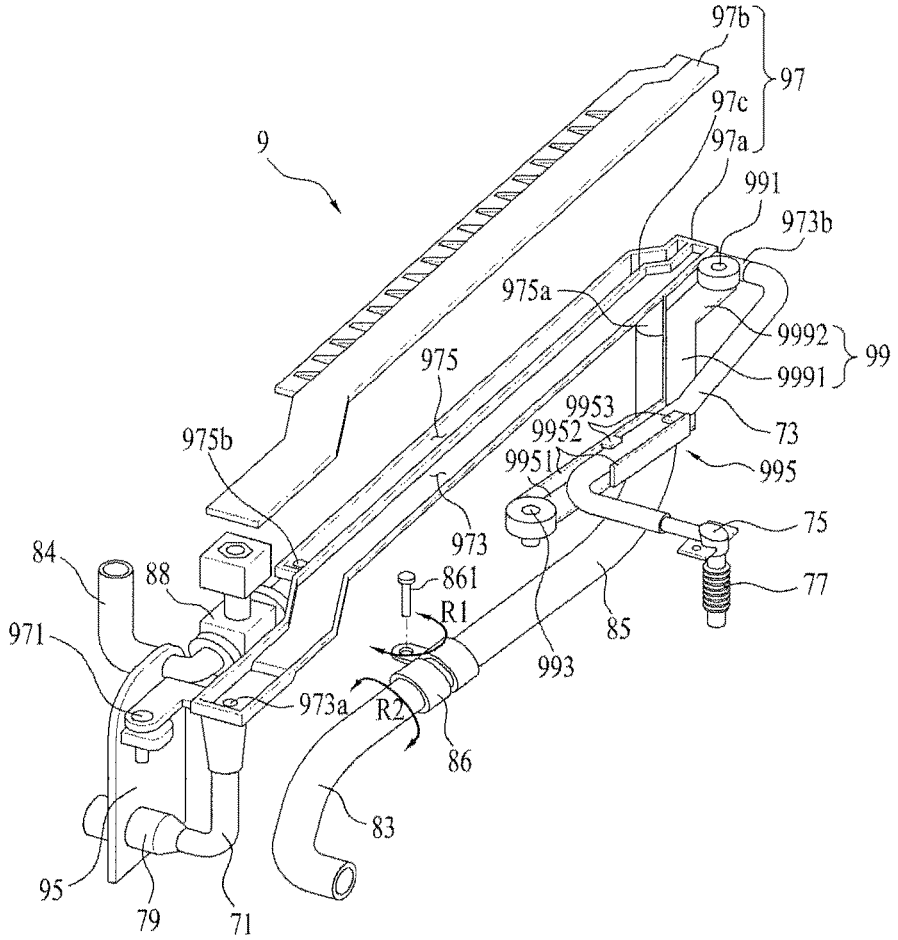

【fig 12】
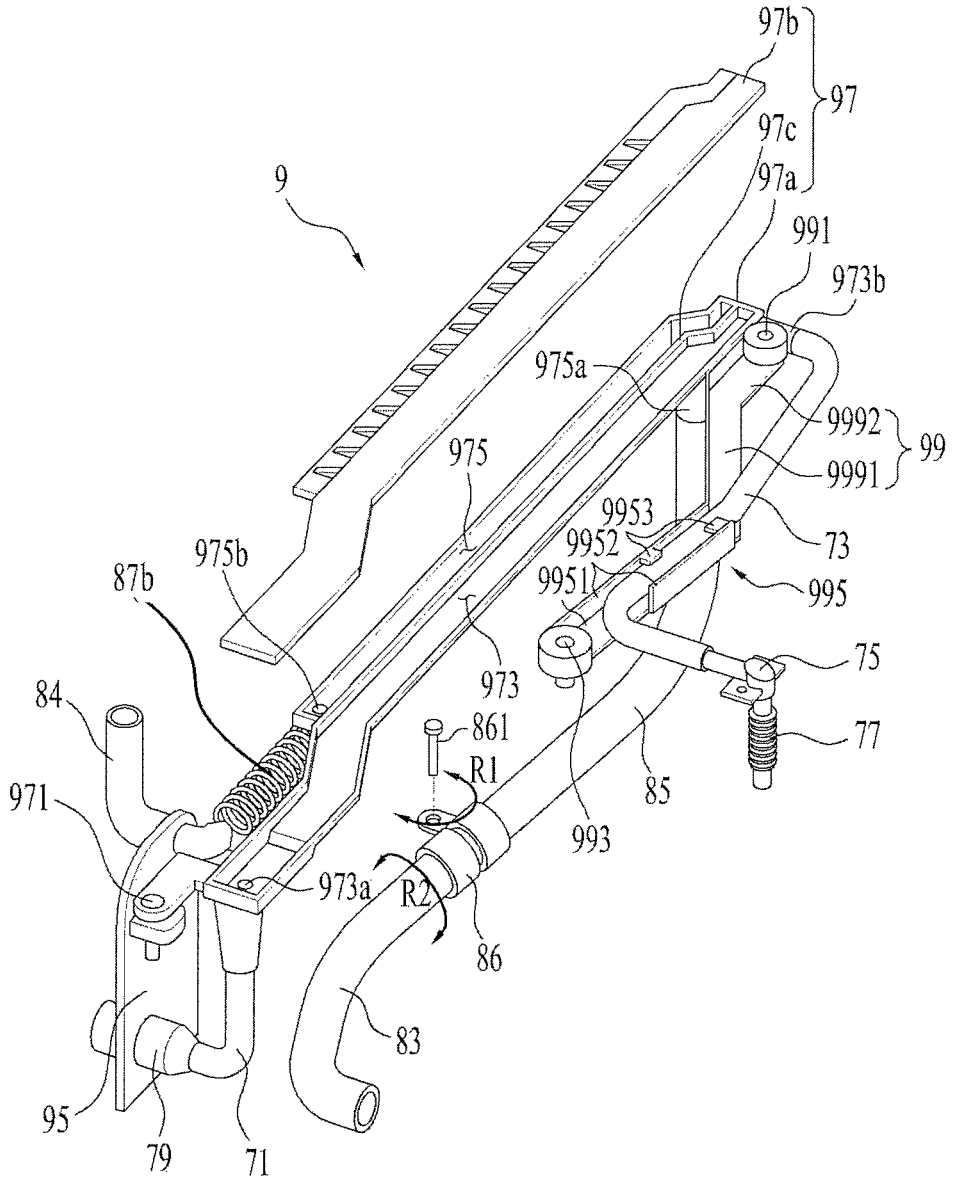

【fig 13】
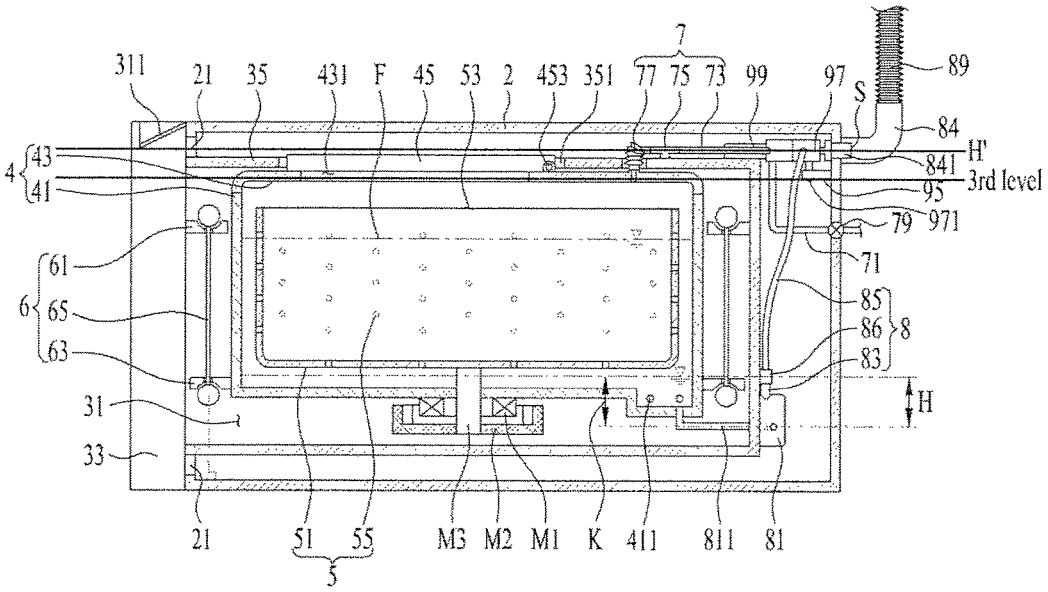

LAUNDRY TREATING APPARATUS

This application claims the benefit of Korean Patent Application No. 10-2015-0125729, filed on Sep. 4, 2015, which is hereby incorporated by reference as if fully set forth herein.

FIELD

The present disclosure relates to a laundry treating apparatus.

BACKGROUND

Typical laundry treating apparatuses includes apparatuses for washing laundry, apparatuses for drying laundry, and apparatuses capable of performing both washing and drying of laundry.

A conventional laundry treating apparatus includes a cabinet, a tub which is provided inside the cabinet to store water therein, and a drum which is provided inside the tub to store laundry therein. Such laundry treating apparatuses are classified into a front-loading type laundry treating apparatus, in which laundry is inserted into a tub through an insertion port provided in the front of the apparatus, and a top-loading type laundry treating apparatus, in which laundry is inserted into a tub through an insertion port provided in the top of the apparatus.

Among them, there is also a laundry treating apparatus including a tub which may be withdrawn from a cabinet. Such a laundry treating apparatus includes a movable water supply part, which serves to supply water to the tub, and a movable discharge part, which serves to discharge water out of the cabinet, when the tub is withdrawn from or is inserted into the cabinet.

SUMMARY

According to an innovative aspect of the subject matter described in this application a laundry treating apparatus includes a cabinet; a tub that is located in the cabinet and that is configured to receive washing water; a drum that is configured to rotate, that is located in the tub, and that is configured to receive laundry; a drainage pump that is configured to pump washing water out of the tub; a connection passage that is configured to guide washing water that is pumped out of the tub by the drainage pump; and a connector that is connected to the connection passage and that is configured to guide washing water out of the cabinet. The connector includes a connector inlet port that is configured to receive washing water; and a connector outlet port that is configured to discharge washing water and that is located above the connector inlet port.

This and other implementations may include one or more of the following optional features. The connector is located above a maximum level of washing water in the tub. The connector outlet port is provided at a position higher than a maximum height of the connector inlet port. The connector outlet port is provided parallel to the ground. The connector outlet port is located above a maximum level of washing water in the tub. The laundry treating apparatus further includes a connector fastening part that is located at an end of the connection passage and that is connected to the connector inlet port; and position guide parts provided in a periphery of the connector fastening part and the connector inlet port and that are configured to fix the connector based on the connector inlet port being coupled to the connector fastening part. The position guide parts include a first position guide part provided in the connector inlet port; and a second position guide part provided in the periphery of the connector fastening part. The first position guide part and the second position guide part are configured to prevent rotation of the connector based on the connector inlet port being coupled to the connector fastening part. The first position guide part is provided in a portion of an edge of the connector inlet port.

The second position guide part is provided in a portion of the periphery of the connector fastening part. When the connector inlet port is coupled to the connector fastening part, the second position guide part forms a remaining portion of the edge of the connector inlet port. The first position guide part has a ring shape, the second position guide part has a protrusion shape, and the second position guide part is inserted into the ring-shaped first position guide part when the connector inlet port is coupled to the connector fastening part. The first and second position guide parts consist of a plurality of first and second position guide parts. The position guide parts includes a protrusion portion provided in the connector inlet port; a circular groove provided in the periphery of the connector fastening part, the connector inlet port being seated in the circular groove; and a protrusion groove provided in the circular groove, and coupled to the protrusion portion. The protrusion portion and the protrusion groove consist of a plurality of protrusion portions and protrusion grooves. The laundry treating apparatus further includes a drawer that includes the tub. The cabinet defines a port that is configured to receive the drawer.

A direction in which the drawer is withdrawn differs from a direction of a rotary shaft of the drum. The connector is located on an outer surface of the cabinet. The connection passage comprises a first connection passage, one end of which is connected to the drainage pump, and a second drainage pipe through which the other end of the first connection passage communicates with the connector inlet port. The second drainage pipe is provided at a position higher than an upper surface of the tub. The connection passage comprises a first connection passage, one end of which is connected to the drainage pump, and a second drainage pipe through which the other end of the first connection passage communicates with the connector inlet port. The second drainage pipe has a certain diameter that extends from one side of an upper surface of the tub to the other side thereof, and extends by rotating at least once. The laundry treating apparatus further includes a valve that is located in at least one of the drainage pump, the connection passage, or the connector and that is configured to adjust a flow rate of washing water flowing through the drainage pump, the connection passage, and the connector. The valve is an electrically controlled solenoid valve. The connector is bent about ninety degrees.

An object of the present subject matter described in this application is to provide a laundry treating apparatus capable of preventing water stored in a tub from leaking through a drainage unit in a process of washing laundry.

BRIEF DESCRIPTION OF THE DRAWINGS

FIG. 1 illustrates an example laundry treatment apparatus.

FIGS. 2 and 13 are cross sectional views of an example laundry treatment apparatus.

FIG. 3 is an exploded view of an example laundry treatment apparatus.

FIGS. 4, 11, and 12 illustrate example supply units, example drainage units, and example guides of laundry treatment apparatuses.

FIG. 5 illustrates an example connector and an example connector fastening part of a drainage unit.

FIGS. 6 and 9 illustrate example connector fastening parts.

FIGS. 7 and 10 illustrate example connectors.

FIG. 8 illustrates an example connector being coupled to an example connector fastening part.

DETAILED DESCRIPTION

As illustrated in FIG. 1, a laundry treating apparatus includes a cabinet 2, a drawer 3 which is configured to withdraw from the cabinet 2, a tub 4 provided in the drawer 3, and a drum 5 which is rotatably provided in the tub 4.

The cabinet 2 may be provided as a means for defining the external appearance of the laundry treating apparatus, or may also be provided as a means for housing the drawer 3. When the cabinet 2 houses the drawer 3, the cabinet 2 may have an opening surface 21 such that the drawer 3 is insertable into or withdrawable from the cabinet 2.

The drawer 3 includes a drawer body 31 which defines the external appearance thereof and is withdrawable from the cabinet 2, a drawer panel 33 which forms the front surface of the drawer and opens and closes the opening surface 21 for the insertion and withdrawal of the drawer, and a drawer cover 35 which forms the upper surface of the drawer body 31.

The drawer panel 33 includes a control panel 331. The control panel 331 controls the operation of the drum 5 in the drawer 3, and may serve to display the state of operation to a user.

The drawer cover 35 may have a first through-hole 351 and a second through-hole 353 therein. The first through-hole 351 may serve as a port for the insertion or withdrawal of laundry, dry clothes, etc., and the second through-hole 353 may serve to supply washing water therethrough.

Laundry may be inserted and withdrawn through the first through-hole 351, and water may be supplied through the second through-hole 353. Therefore, in some implementations, the first through-hole 351 to have a size larger than the second through-hole 353.

In some implementations, the drawer 3 is withdrawn forward from the cabinet 2, and an external water supply source is provided on the back of the cabinet 2. Therefore, in some implementations, the second through-hole 353 to be located behind the first through-hole 353.

In addition, since a door, which will be described later, has a structure that is opened and closed, the first through-hole 351 is may be formed to have a rectilinear portion formed on the back thereof and a curved portion connected to both ends of the rectilinear portion.

For example, the first through-hole 351 may have a semicircular shape or a half-track shape.

The first and second through-holes 351 and 353 will be described in more detail later. As illustrated in FIG. 2, the tub 4 may include a tub body 41 which defines the external appearance thereof, a tub cover 43 which forms the upper surface of the tub body 41, and a door 45 through which the inside and outside of the tub 4 communicate with each other and through which laundry is insertable and withdrawable.

The tub body 41 is arranged inside the drawer 3. The tub body 41 may have a cylindrical shape that is partially opened at the upper surface thereof, and may include a heater 411 which heats washing water or air. The heater 411 may be provided in the lower portion of the tub body 41 in order to heat washing water. The tub cover 43 forming the upper surface of the tub body 41 may be provided with an insertion port 431 and a supply port 433, through which the inside and outside of the tub communicate with each other. The insertion port serves as a passage for the insertion of laundry or dry clothes, and the supply port 433 serves as a passage for the supply of washing water.

The insertion port 431 communicates with the first through-hole 351, and they serve as a passage for the movement of laundry or dry clothes. The supply port 433 communicates with the second through-hole 353, and they serve as a passage for the supply of washing water.

The drum 5 is rotatably arranged inside the tub 4. The drum 5 includes a drum body 51 which defines the external appearance thereof. The drum body 51 has an opening surface 53 which is opened at the upper portion thereof. The insertion port 431 provided in the tub communicates with the opening surface 53, and laundry or dry clothes may be inserted into or withdrawn from the drum body 51 through the insertion port 431 and the opening surface 53. In addition, the drum body 51 may have a drum through-hole 55 for the insertion and withdrawal of washing water.

The drum 5 may be rotated by a drive part, and may be fixed on the outer bottom of the tub body 41. The drive part includes a stator M1 and a rotor M2, which is rotated by a rotating field generated in the stator, and may rotate clockwise or counterclockwise about a drive shaft M3 within the tub body 41. The drive shaft M3 is provided so as to be perpendicular to the bottom of the tub body 41.

In addition, the tub 4 is coupled to the drawer body 31 by a tub support part 6. The tub support part 6 may include a first support part 61 provided in the drawer body 31, a second support part 63 provided in the tub body 41, and a connection part 65 which connects the first and second support parts 61 and 63.

The laundry treating apparatus 100 having the above structure include a water supply unit 7 for supplying washing water and a drainage unit 8 for discharging the washing water supplied into the laundry treating apparatus 100. The water supply unit 7 serves to supply water into the tub 4, and the drainage unit 8 serves to discharge the water stored in the tub out of the cabinet 2.

The tub 4 is supplied with washing water from the water supply unit 7. In this case, the washing water may be supplied until it reaches a level that is at a predetermined distance below the opening surface 53 of the drum 5.

Laundry is received in the drum 5. Therefore, if washing water is supplied up to the opening surface 53 of the drum 5, the washing water may overflow into the tub 4 from the drum 5.

Accordingly, the level, which is above the bottom of the tub 4 and is at a predetermined distance below the opening surface 53 of the drum 5, may be referred to as a normal level or a first level ($1^{st}$ level).

When washing water is supplied above the first level, the washing water overflows. The overflowing washing may not be used to wash laundry, and causes the tub 4 to be heavier. Therefore, washing water may be supplied up to the first level.

In addition, washing water may be supplied through the tub 4 until it reaches the opening surface 53 of the drum 5.

In this case, when washing water is supplied until it reaches the opening surface 53 of the drum 5 beyond the first level, the washing water may overflow into the tub 4.

Accordingly, the level in this state may be referred to as an abnormal level or a second level ($2^{nd}$ level).

In some implementations, the second level ($2^{nd}$ level) is a theoretical maximum level up to which washing water may be supplied into the drum 5 if laundry is not present in the drum 5 or the drum 5 is not rotated.

However, when washing water reaches the tub cover 43 in the tub 4, the washing water may overflow from the tub 4.

In addition, when washing water reaches the tub cover 43, the washing water may flow to the drawer 3 from the tub 4 due to vibrations occurring when the drum 5 rotates.

The level in this state may be referred to as an overflow level or a third level ($3^{rd}$ level). The third level ($3^{rd}$ level) is a theoretical maximum level up to which washing water may be received in the tub 4.

In addition, even when washing water is not supplied up to the third level ($3^{rd}$ level) in the tub 4, the washing water may reach the third level ($3^{rd}$ level) when a large vibration occurs due to the rotation of the drum 5.

In this case, the washing water may overflow from the tub 4 even if it is not supplied up to the third level ($3^{rd}$ level).

When the washing water overflows from the tub 4, it may flow to the drawer 3. However, since the washing water is discharged to a drainage passage to be described later, the amount of washing water in the tub 4 may be reduced.

Thus, it may be necessary to include a connector 84 which prevents the washing water in the tub 4 from overflowing or being discharged therefrom. A detailed description thereof will be given later.

As illustrated in FIG. 3, the tub cover 43 may be provided with the door 45 for opening and closing the insertion port 431. The door 45 may include a frame 451 which is rotatably coupled to the tub cover 43 by a hinge 453, a window 455 which is provided on the frame and is made of a transparent material such that the user may check the inside of the tub body 41, and a door handle 457 which aids in detachably coupling the frame 451 to the tub cover 43.

The door 45 may open or close the tub cover 43 while rotating up or down about the hinge 453. The door 45 may be rotated only above the tub cover 43.

This enables the user to open and close the door 45, and is intended to prevent contact with washing water and laundry in the tub 4.

Therefore, the door 45 may be seated on the upper portion of the tub cover 43.

That is, the door 45 may be seated on the outer peripheral surface of the upper portion of the insertion port 431.

In this case, the through-hole 351 may have the same shape as the door 45 such that the door 45 may open and close the insertion port 431 while rotating about the hinge 453.

The door 45 may have a rectilinear portion at a position at which the hinge 453 is installed such that the door 45 is rotatable about the hinge 453, and may have a curved portion at a position at which the hinge 453 is not installed such that the insertion and withdrawal of laundry is performed therethrough.

That is, the curved portion may have any curvature as long as both ends of the curved portion may be coupled to both ends of the rectilinear portion.

For example, the door 45 may have a semicircular shape or a half-track shape.

In some implementations, the through-hole 351 to have the same shape as the door 45, and to have a size larger than the door 45.

The through-hole 351 may further include a cut portion 3511 which is formed at a position corresponding to the handle 457, such that the user may grip the handle 457.

In this case, the handle 457 may be disposed on the front surface of the frame 451 such that the door may be opened and closed in a balanced state.

That is, the handle 457 may be provided so as to have a symmetrical shape about the front central portion of the frame 451.

This is intended to prevent the door 45 from leaning to either the left or right of the handle 457 due to the self-weight of the door 45 when the door 45 is opened or closed.

The first through-hole 351 may include the cut portion 3511 which is formed at a position corresponding to the handle 457, such that the user may grip the door handle 457. The drawer cover 35 may further include extension ribs 352 which extend downward from both side ends thereof.

The extension ribs 352 may guide the drawer cover 35 such that they are coupled to the upper end of the drawer body 31, whereby the drawer cover 35 is fixed to the drawer body 31.

In some implementations, each of the extension ribs 352 may have a plurality of holes into which fastening members such as bolts or nuts are inserted, or may have a structure that is fitted into the drawer body 31.

The fitting may be performed by coupling a slide, which is formed in one of the drawer body 31 and the inner surface of the extension rib 352, to a rail which is formed in the other of the drawer body 31 and the extension rib 352.

In addition, the fitting may be performed by coupling a hook and a receiving groove.

That is, the fitting may be performed in any manner as long as the extension rib 352 may be fastened to the drawer body 31.

A water supply passage 73, which will be described later, may be provided with a fastening pipe 75 which is fixed and fastened to the drawer cover 35.

The fastening pipe 75 may include fastening ribs 751 at both ends thereof, and the drawer cover 35 may further include fastening grooves 353 to which the fastening ribs 751 are coupled.

The fastening pipe 75 may serve to stably fix the water supply passage 73 when the drawer 3 vibrates due to the vibration of the tub 4.

In addition, since the fastening pipe 75 stably fixes the water supply passage 73 when the drawer 3 moves forward or rearward, it is possible to prevent damage to the water supply passage 73.

The connection part 65 may include a first connection part 651 which is seated in the first support part 61, a second connection part 653 which supports the second support part 63, and a bar 655 which connects the first and second connection parts.

In some implementations, the first connection part 651 to be seated in the first support part 61 and to have a shape that is rotatable within the first support part 61, and for the second connection part 653 to support the second support part 63 and to have a shape that is rotatable within the second support part 63.

FIG. 3 illustrates an example laundry treatment apparatus and an example in which each of the first and second connection parts 651 and 653 has a spherical shape, and an example in which the contact surface between each support part and an associated connection part has a semispherical shape.

As illustrated in FIG. 3, the bar 655 may be formed so as to be perpendicular to the bottom of the cabinet 2, and the tub body 41 may be coupled to the drawer body 31 by at least three tub support parts.

In some implementations, if the water supply unit 7 and the drainage unit 8 are provided as a hose for connecting the water supply source and the supply port 433 and a hose for guiding the water in the tub to the outside of the cabinet, there is a risk that they will be damaged when the drawer 3 is withdrawn from the cabinet 2. In order to prevent this risk, the laundry treating apparatus 100 may further include a guide 9, which is provided in the cabinet 2 and aids the smooth movement of the water supply unit 7 and the drainage unit 8. The water supply unit 7, the drainage unit 8, and the guide 9 will be described with reference to FIGS. 4 and 5.

The guide 9 includes a first body 97 and a second body 99. One end of the first body 97 is rotatably connected to a support part 95 fixed to the cabinet 2, and the other end thereof is rotatably connected to one end of the second body 99. The other end of the second body 99 is rotatably connected to the drawer cover 35.

The first body 97 includes a base 97*a* which serves as a passage through which supplied water and discharged washing water are movable, and a cover 97*b* which seals the upper surface of the base 97*a*. In addition, the base 97*a* may further include a partition wall 97*c* therein such that the supplied water does not mix with the discharged washing water. The partition wall 97*c* serves to divide the base 97*a* into a water supply connection pipe 973, which is a passage for the movement of water supplied from the water supply source, and a drainage connection pipe 975 which is a passage for the discharge of washing water in the tub.

The first body 97 is connected, at one end thereof, to the support part 95 so as to be rotatable about a first shaft 971, and the first shaft is perpendicular to the ground. One end of the second body 99 may be connected to the other end of the first body such that the second body 99 is rotatable about a second shaft 991, and the second shaft is also perpendicular to the ground. The second body 99 is connected, at the other end thereof, to the drawer cover 35 so as to be rotatable about a third shaft 993, and the third shaft is perpendicular to the ground. Since the first and second bodies 97 and 99 are rotatable about the first, second, and third shafts 971, 991, and 993, the drawer body 31 may be smoothly inserted into or withdrawn from the cabinet 2.

The water supply unit 7 and the drainage unit 8 may be coupled to the guide 9. Due to coupling with the guide 9, it is possible to reduce damage to or tangles of the water supply unit 7 and the drainage unit 8 even when the drawer body 31 is inserted into or withdrawn from the cabinet 2.

The water supply unit 7 may include a first water supply passage 71, one end of which is connected to the support part 95 while the other end of which is connected to the water supply connection pipe 973, a water supply valve 79 which may adjust the amount of water supplied to the first water supply passage 71, and a second water supply passage.

The second water supply passage includes a first water supply pipe 73, which is a passage for supplying water from the water supply connection pipe 973 into the tub 4, a second water supply pipe 77, which is connected to the supply port 433 provided in the tub cover 43 and has a corrugated shape, and a fastening pipe 75 which connects the first and second water supply pipes. The second water supply pipe 77 is provided so as to have a corrugated shape in order to prevent the vibration of the tub 4 from being transferred to the fastening pipe 75.

The first water supply passage 71 is connected to the water supply connection pipe 973 through a water-supply-connection-pipe introduction port 973*a*, and the first water supply pipe 73 is connected to the water supply pipe 973 through a water-supply-connection-pipe discharge port 973*b*.

The supply path of water from the water supply source will be described below. The water supplied from the water supply source is introduced into the first water supply passage 71, and is then introduced into the water supply connection pipe 973 through the water-supply-connection-pipe introduction port 973*a*. The water introduced into the water supply connection pipe 973 is supplied to the first water supply pipe 73 through the water-supply-connection-pipe discharge port 973*b*, and the water supplied to the first water supply pipe is finally supplied into the tub body 41 through the fastening pipe 75 and the second water supply pipe 77.

The first water supply pipe 73 may have a hose shape made of rubber, or a corrugated shape. The second body 99 serves to support the first water supply pipe 73. The second body 99 may have a water-supply-pipe receiving part 995 having a protrusion shape, and the water-supply-pipe receiving part 995 prevents the first water supply pipe 73 from being separated from the second body 99. In addition, the first water supply pipe 73 may be detachably provided in the second body 99.

The water-supply-pipe receiving part 995 may include a support 9911 which extends from the lower portion of the third shaft 993, receiving ribs 9912 which extend upward from both ends of the support, and protruding portions 9913 which protrude from the free ends of the receiving ribs 9912 so as to be close to each other parallel to the support 9911.

The water-supply-pipe receiving part 995 may have an opened upper surface.

The support 9911 and the receiving ribs 9512 may be fixed in the state in which the first water pipe 73 is received in the water-supply-pipe receiving part 995, and the protruding portions 9513 may prevent the first water supply pipe 73 from being separated or dislocated due to external impact.

The second body 99 may include an inclined portion 9991, which is connected to the second shaft 991 and is spaced apart from the first body 97.

The inclined portion 9991 may prevent the first and second bodies 97 and 99 from being damaged due to collision therebetween when the tub 4 vibrates, by maintaining the distance from the first body 97.

In addition, the water supply pipes 73 and 77 may allow the length that extends from the second body 99 to the second through-hole 353 to be minimized, thereby maximizing stability.

The second body 99 further includes a first rectilinear portion 9992 provided parallel to the first body 97, and the inclined portion 9991 may extend from the end of the first rectilinear portion 9992.

The water-supply-pipe receiving part 995 may extend from the end of the inclined portion 9991.

The drainage unit 8 may include a drainage pump 82 which is fixed to the rear surface of the drawer 3 to discharge the washing water stored in the tub body 41, a connection passage through which the washing water discharged by the drainage pump 82 is guided out of the cabinet 2, a connector 84 which is provided outside the cabinet 2 and prevents the washing water discharged from the connection passage from leaking when the drainage pump 82 is not operated, a drainage passage 89 (see FIG. 2) which is connected to the connector 84 and through which washing water is finally discharged out of the laundry treating apparatus.

The connection passage includes a first connection passage 83, one end of which is connected to a drainage chamber 81 provided with the drainage pump 82 while the other end of which is connected to a first drainage pipe 85, the first drainage pipe 85 which is connected to the first connection passage 83 through a passage connection part 86, and a second drainage pipe 87, one end of which is connected to the drainage connection pipe 975 while the other end of which is connected to the support part 95.

In more detail, the washing water in the tub 4 is introduced into the drainage connection pipe 975 through the first drainage pipe 85 via the first connection passage 83 using the drainage pump 82. In this case, the washing water in the first drainage pipe 85 is introduced into the drainage connection pipe 975 through a drainage-connection-pipe introduction port 975*a*. The washing water introduced into the drainage connection pipe 975 is discharged to the second drainage pipe 87 through a drainage-connection-pipe discharge port 975*b*, and the washing water introduced into the second drainage pipe 87 is discharged to the connector 84 provided outside the cabinet 2.

The connector 84 serves to prevent the washing water introduced into the drainage pipe 87 from flowing out of the tub 4. Referring to FIGS. 6 to 8, the connector 84 is connected to a connector fastening part 841 which is provided at the end of the connection passage while a portion thereof protrudes out of the cabinet 2. In more detail, the connector fastening part 841 is connected to a connector inlet port 847 corresponding to the inlet of the connector 84 which is supplied with washing water from the connection passage.

In addition, the connector 84 includes a connector outlet port 849 which is an outlet for discharging the introduced washing water. That is, the washing water, which is introduced into the connector inlet port 847 from the connection passage, is discharged to the connector outlet port 849 via the inside of the connector 84.

The connector inlet port 847 or the connector outlet port 849 may be provided at a point (S) higher than the third level ($3^{rd}$ level), the third level being a maximum level of water which may be stored in the tub 4. This is intended to prevent the washing water in the tub 4 from leaking through the connector outlet port 849 in the process of washing laundry.

In the drainage unit 8 having the above structure, when the operation of the drainage pump 82 is stopped, the washing water remaining in the connector 84 and the connection passage will be introduced into the tub 4 by self-weight thereof. Moreover, when a level (K) of water introduced into the tub is higher than the portions 83 and 85 of the connection passage, water remains in the connection passage.

When washing water remains in the connection passage, the washing water may freeze when the temperature of outside air is low as in winter. For this reason, the connection passage may be damaged when the drawer 3 is withdrawn from the cabinet 2.

Accordingly, when the connection passage is provided at a position (H) higher than the level (K) defined in the tub due to the movement of water, which is stored between the point (S) higher than the third level and the drainage pump 82, to the tub 4, it is possible to prevent water from remaining in the connection passage. It is based on the premise that the reference positions for measuring the level (K) and the position (H) are the same as each other, and it can be seen that a chamber communication pipe 811 is illustratively provided as the reference position, as illustrated in FIG. 4.

In some implementations, the drum 5 is rotated by the drive part when washing is performed in the laundry treating apparatus 100. In this case, a water stream occurs in the washing water in the tub body 41 due to the rotation of the drum 5, and vibrations occur in the tub and the drainage unit 8 and the guide 9, which are adjacent thereto, due to the occurrence of the water stream. Due to the water stream, the vibrations, or the combination thereof, the washing water, which remains in the second drainage pipe 87 connected to the connector 84 and the drainage connection pipe 975 adjacent to the second drainage pipe, may leak out of the cabinet through the connector fastening part 841 provided at the end of the connection passage.

In order to resolve these problems, the connector outlet port 849 may be provided at a position higher the connector inlet port 847, as illustrated in FIG. 7.

The connector inlet port 847 or the connector outlet port 849 are provided at a point (S) equal to or higher than the maximum height (F) of washing water which may be received in the tub body 41 (see FIG. 2). In this case, washing water does not generally leak, but some of washing water may leak in the above-mentioned situation. Therefore, when the connector outlet port 849 is provided at a position that is at a predetermined distance above the connector inlet port 847, it is possible to remarkably prevent washing water from leaking.

FIG. 7 illustrates an example connector where the connector outlet port 849 is provided at a position that is at a distance of "L" above the uppermost portion of the connector inlet port 847.

In some implementations, and the connector outlet port 849 may any shape as long as the connector outlet port 849 is provided at a position higher than the connector inlet port 847.

In addition, the connector outlet port 849 may be directed in any direction as long as the connector outlet port 849 is provided at a position higher than the connector inlet port 847. In some implementations, the connector outlet port 849 is directed upward. That is, the connector outlet port 849 may be provided parallel to the ground.

As described above, the connector outlet port 849 may be provided at a position (L) higher than the maximum height of the connector inlet port 847 in order to more securely prevent the leakage of washing water, and the drainage passage 89 may be detachably provided in the connector outlet port 849. However, the drainage passage 89 may be integrally formed with the connector outlet port 849.

The drainage passage 89 may be made of any material, but it may have a hose shape that is made of rubber such that the drainage direction is adjustable.

In order for the connector 84 to properly perform the above functions, position guide parts may be provided in the connector inlet port 847 and the connector fastening part 841. The position guide parts prevent the connector 84 from rotating after it is coupled to the connector fastening part.

Hereinafter, the structure in which the connector 84 is connected to the connector fastening part 841 corresponding to the end of the connection passage protruding out of the cabinet 2 will be described with reference to FIGS. 6 to 8.

In some implementations, a first position guide part 843 may be provided in a portion of the edge of the connector inlet port 847, and a second position guide part 845 may be provided in the periphery of the connector fastening part 841.

When the connector inlet port 847 is coupled to the connector fastening part 841, the first and second position guide parts 843 and 845 come into contact with each other.

That is, the second position part 845 forms a remaining portion of the edge of the connector inlet port 847, in which the first guide part 843 is not formed. Accordingly, it is possible to reduce a risk that the connector outlet port 849 will be located at a position lower than the connector inlet port 847 due to the rotation of the connector when the connector 84 is coupled to the connector fastening part 841.

In some implementations, a connector inlet port 847 is provided with a first position guide part, which is located in the same plane as the connector inlet port and has a ring shape, and a second position guide part 845 located in the periphery of a connector fastening part 841 may protrude so as to have a protrusion shape. When the connector inlet port 847 is coupled to the connector fastening part 841, the protrusion-shaped second position guide part 845 may be inserted into the ring-shaped first position guide part. That is, the coupling of the first and second position guide parts prevents the rotation of a connector 84 even when the connector is coupled to the connector fastening part. In addition the first and second position guide parts may be provided as a plurality of pairs consisting of first and second position guide parts.

FIG. 9 illustrates an example connector fastening part. FIG. 10 illustrates an example connector. The structure except for the position guide parts that include the connector fastening part and the connector is similar to the structure described above.

A connector inlet port 847 may be provided with a protrusion portion 843*a* in the same plane as the connector inlet port 847, and a protrusion groove 845*a* corresponding to the protrusion portion 843*a* may be provided in the periphery of a connector fastening part 841. In addition, the periphery of a connector fastening part 841 may be provided with a circular groove 845*b*, which is located in the same plane as the protrusion groove 845*a* and has a shape corresponding to that of the connector inlet port 847.

Accordingly, when the connector inlet port 847 is coupled to the connector fastening part 841, the protrusion portion 843*a* is coupled to the protrusion groove 845*a* and the connector inlet port 847 is coupled to the circular groove 845*b*, thereby preventing the rotation of a connector 84 after it is coupled to the connector fastening part. In addition, the protrusion portion 843*a* and the protrusion groove 845*a* may be provided as a plurality of pairs consisting of protrusion portions and protrusion grooves.

In order to more securely couple the connector inlet port 847 and the connector fastening part 841, magnets may be respectively provided at the coupling portions between the connector inlet port 847 and the connector fastening part 841.

FIG. 11 illustrates an example supply unit, an example drainage unit, and an example guide that are configured to prevent washing water in the tub 4 from being randomly discharged.

The laundry treating apparatus may further include a valve 88, which is provided in at least one of the drainage pump 82, the connection passage including the first connection passage 83 and the first and second drainage pipes 85 and 87, and the connector 84, so as to adjust the flow rate of washing water passing through the drainage pump 82, the connection passage, and the connector 84.

That is, the valve 88 may prevent the washing water in the tub 4 from being actively discharged, and may prevent the washing water in the tub 4 from being randomly discharged.

The valve 88 may be an electrically controlled solenoid valve. The valve 88 may be provided in at least one of the drainage pump 82, the connection passage, and the connector 84, so as to open at least one of the drainage pump 82, the connection passage, and the connector 84 in response to a drainage signal from a controller.

FIG. 11 illustrates an example in which the valve 88 is provided in the second drainage pipe 87 of the connection passage. In some implementations, the valve is provided in another one of the above components.

FIG. 12 illustrates an example supply unit, an example drain unit, and an example guide that are configured to prevent washing water in the tub 4 from being randomly discharged.

In some implementations, a connection passage includes a first connection passage 83, one end of which is connected to the drainage pump, a first drainage pipe 85, and a second drainage pipe 87*b* through which the other end of the first connection passage communicates with the connector inlet port 847. The second drainage pipe 87*b* may have a certain diameter that extends from one side of the upper surface of the tub to the other side thereof, and may extend by rotating at least once.

The second drainage pipe 87*b* may have a twisted shape or a consistent ring shape.

That is, the second drainage pipe 87*b* is provided in the form of a long passage, which may lead to maximization of passage resistance.

Accordingly, the washing water passing through the second drainage pipe 87 does not flow forward due to the passage resistance, but may remain or return due to the self-weight thereof.

That is, may be necessary to generate a pressure in the drainage pump 82 in order to overcome the passage resistance.

In other words, the washing water in the tub 4 may be discharged to the connector 84 only when the drainage pump 82 is operated, and the washing water may not pass through the second drainage pipe 87*b* due to only vibrations of the tub 4 and the drum 5.

FIG. 13 illustrates an example laundry treatment apparatus that is configured to prevent washing water in the tub 4 from being randomly discharged.

Similar to the above description, a connection passage includes a first connection passage 83, one end of which is connected to the drainage pump 82, a first drainage pipe 85, and a second drainage pipe 87 through which the other end of the first connection passage 83 communicates with the connector inlet port. In this case, the second drainage pipe 87 may be provided at a position higher than the upper surface of the tub.

That is, the second drainage pipe 87 may be provided at a position higher than the tub cover 43 of the tub 4.

Consequently, the head of the second drainage pipe 87 and the connector 84 connected to the second drainage pipe 87 is increased, and thus it is possible to prevent the washing water received in the tub 4 from flowing to the connector 84.

As is apparent from the above description, the laundry treatment apparatus has an effect of preventing water stored in a tub from leaking through a drainage unit in the process of washing laundry.

What is claimed is:

1. A laundry treating apparatus comprising:

a cabinet;

a tub that is located in the cabinet and that is configured to receive washing water;

a drum that is configured to rotate, that is located in the tub, and that is configured to receive laundry;

a drainage pump that is configured to pump washing water out of the tub;

a connection passage that is configured to guide washing water that is pumped out of the tub by the drainage pump and that extends from the drainage pump to a rear of the cabinet;

a connector that is detachably connected at the rear of the cabinet to communicate with the connection passage and that is configured to guide washing water out of the cabinet; and a drain pipe that is detachably connected to the connector, wherein the connector comprises:

a connector inlet port that is configured to receive washing water from the connection passage; and a connector outlet port that is connected to the drain pipe to discharge washing water to the drain pipe, and wherein the connector outlet port is maintained above than the connector inlet port.

2. The laundry treating apparatus according to claim 1, wherein the connector is located above a maximum level of washing water in the tub.

3. The laundry treating apparatus according to claim 2, wherein:

the connection passage comprises a first connection passage, one end of which is connected to the drainage pump, and a pipe through which the other end of the first connection passage communicates with the connector inlet port; and the pipe is provided at a position higher than an upper surface of the tub.

4. The laundry treating apparatus according to claim 2, wherein:

the connection passage comprises a first connection passage, one end of which is connected to the drainage pump, and a pipe through which the other end of the first connection passage communicates with the connector inlet port; and the pipe extends from one side of an upper surface of the tub to the other side thereof, and extends by rotating at least once.

5. The laundry treating apparatus according to claim 1, wherein a cross section of the connector outlet port is provided parallel to the ground.

6. The laundry treating apparatus according to claim 5, wherein the connector outlet port is located above a highest level at which washing water is received in the tub.

7. The laundry treating apparatus according to claim 1, further comprising:

a connector fastening part that is located at an end of the connection passage and that is connected to the connector inlet port; and position guide parts provided in a periphery of the connector fastening part and the connector inlet port and that are configured to fix the connector based on the connector inlet port being coupled to the connector fastening part.

8. The laundry treating apparatus according to claim 7, wherein the position guide parts comprise:

a first position guide part provided in the connector inlet port; and a second position guide part provided in the periphery of the connector fastening part, and wherein the first position guide part and the second position guide part are configured to prevent rotation of the connector based on the connector inlet port being coupled to the connector fastening part.

9. The laundry treating apparatus according to claim 8, wherein:

the first position guide part is provided in a portion of an edge of the connector inlet port;

the second position guide part is provided in a portion of the periphery of the connector fastening part; and when the connector inlet port is coupled to the connector fastening part, the second position guide part forms a remaining portion of the edge of the connector inlet port.

10. The laundry treating apparatus according to claim 8, wherein the first position guide part has a ring shape, the second position guide part has a protrusion shape, and the second position guide part is inserted into the ring-shaped first position guide part when the connector inlet port is coupled to the connector fastening part.

11. The laundry treating apparatus according to claim 10, wherein the first and second position guide parts consist of a plurality of first and second position guide parts.

12. The laundry treating apparatus according to claim 7, wherein the position guide parts comprise:

a protrusion portion provided in the connector inlet port;

a circular groove provided in the periphery of the connector fastening part, the connector inlet port being seated in the circular groove; and a protrusion groove provided in the circular groove, and coupled to the protrusion portion.

13. The laundry treating apparatus according to claim 12, wherein the protrusion portion and the protrusion groove consist of a plurality of protrusion portions and protrusion grooves.

14. The laundry treating apparatus according to claim 1, further comprising:

a drawer that includes the tub, wherein the cabinet defines a port that is configured to receive the drawer.

15. The laundry treating apparatus according to claim 14, wherein a direction in which the drawer is withdrawn differs from a direction of a rotary shaft of the drum.

16. The laundry treating apparatus according to claim 1, wherein the connector is located on an outer surface of the cabinet.

17. The laundry treating apparatus according to claim 1, further comprising a valve that is located in at least one of the drainage pump, the connection passage, or the connector and that is configured to adjust a flow rate of washing water flowing through the drainage pump, the connection passage, and the connector.

18. The laundry treating apparatus according to claim 17, wherein the valve is an electrically controlled solenoid valve.

19. The laundry treating apparatus according to claim 1, wherein the connector is bent about ninety degrees.

20. A laundry treating apparatus comprising:

a drawer;

a cabinet that is configured to receive the drawer;

a tub that is located in the drawer and that is configured to receive washing water;

a drum that is configured to rotate and that is configured to receive laundry;

a drain unit that comprises:

a drainage pump that is configured to discharge washing water from the tub;

a connection passage that is configured to guide, out of the cabinet, washing water discharged by the drainage pump; and a drain pipe that is provided outside of the cabinet;

a guide that is rotatably coupled to the drawer and to the cabinet and that is configured to guide the connection passage;

a support part that is located on the cabinet, that is rotatably coupled to an end of the guide, and that is higher than an upper surface of the tub; and a connector that is provided to be detachably coupled at the support part and connect to the drain pipe, wherein the connector comprises:

a connector inlet port that is configured to receive washing water from the connection passage; and a connector outlet port that is connected to the drain pipe to discharge washing water to the drain pipe, and wherein the connector outlet port is maintained above than the connector inlet port.

21. The laundry treating apparatus according to claim 20, wherein:

the guide includes a first body and a second body that are configured to guide the connection passage, an end of the first body is rotatably connected to the support part, another end of the first body is rotatably connected to an end of the second body, and another end of the second body is rotatably connected to the drawer.

* * * * *